United States Patent [19]

Kamal

[11] 4,347,955

[45] Sep. 7, 1982

[54] REVERSED MOVING DIE FOLDING AND CREASING MACHINE

[76] Inventor: Nabil Kamal, 8166 St. Denis St., Montreal, Quebec, Canada

[21] Appl. No.: 167,400

[22] Filed: Jul. 10, 1980

Related U.S. Application Data

[63] Continuation-in-part of Ser. No. 137,644, Apr. 7, 1980, abandoned.

[51] Int. Cl.[3] ..... A41H 33/00

[52] U.S. Cl. ..... 223/38

[58] Field of Search ..... 223/37, 38; 112/120

[56] References Cited

U.S. PATENT DOCUMENTS

| | | | |
|---|---|---|---|
| 2,858,967 | 11/1958 | Gilbert | 223/38 |
| 3,143,091 | 8/1964 | Arbter | 223/38 X |
| 3,493,151 | 2/1970 | Scherr | 223/38 |
| 3,730,404 | 5/1973 | Schramayr et al. | 223/38 |
| 4,124,424 | 11/1978 | Preston | 223/38 |

*Primary Examiner*—Louis Rimrodt

*Attorney, Agent, or Firm*—Alan Swabey; Guy Houle; Robert Mitchell

[57] ABSTRACT

An edge folding and creasing machine for folding and creasing edges in fabrics and wherein there is provided a moving die displaceable to and away from a stationary support plate. A flat punch head is reciprocable and retractable in a cavity provided in the support plate. The die has a die cavity with a wall surface juxtaposed to an open end of the cavity. Folding plates are provided adjacent the open end of the cavity to fold a protruding marginal portion of a fabric held in the die cavity by the flat punch head. The punch head is retractable on its planar axis out of the folded marginal creased edge of the fabric and back into the stationary support plate. The fabric with the folded circumferential edge is retained in the die cavity and released therefrom after the die cavity has been displaced away from the support plate.

14 Claims, 14 Drawing Figures

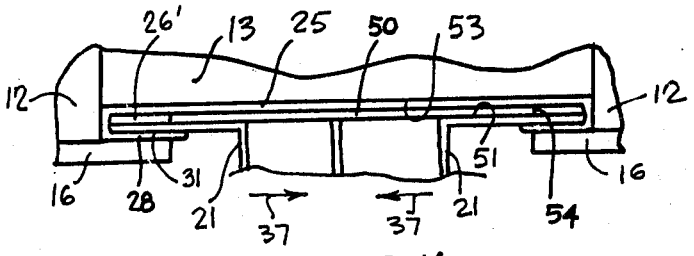
FIG. 14
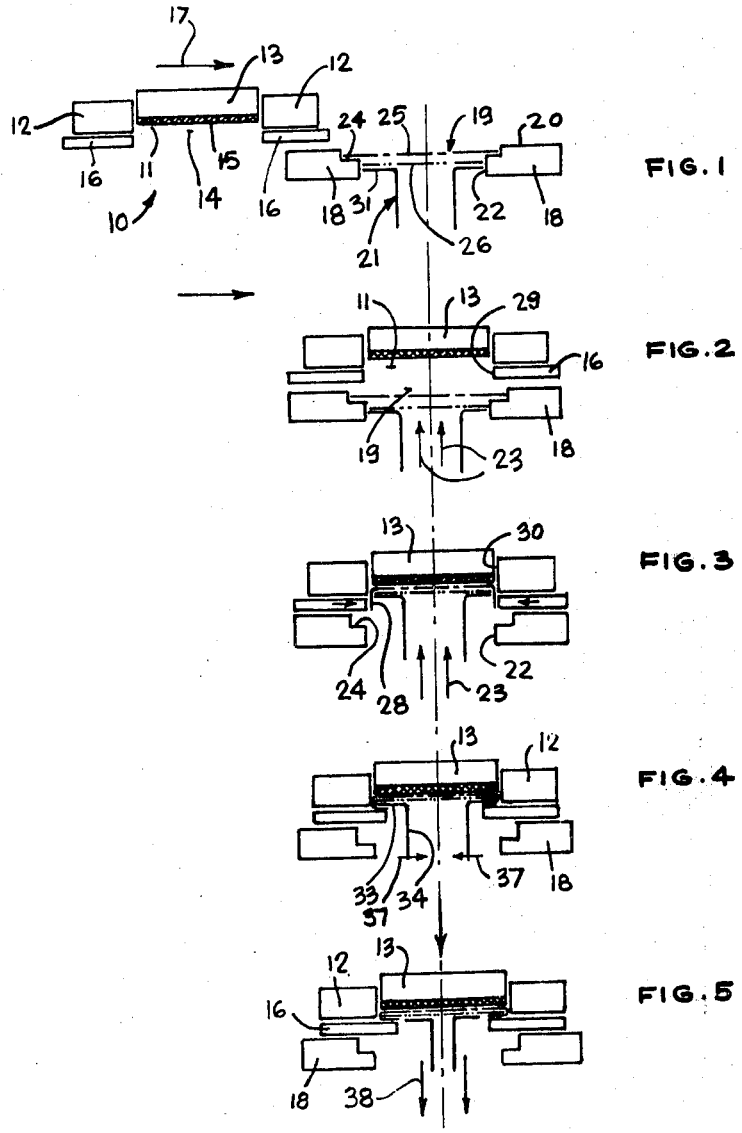
FIG. 1
FIG. 2
FIG. 3
FIG. 4
FIG. 5

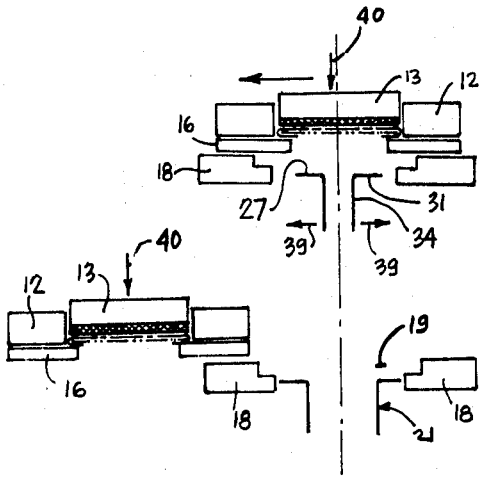
FIG. 6
FIG. 7
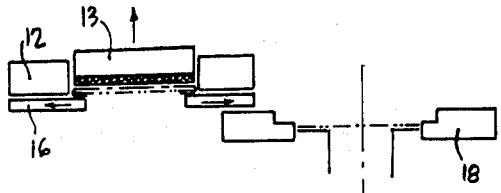
FIG. 8
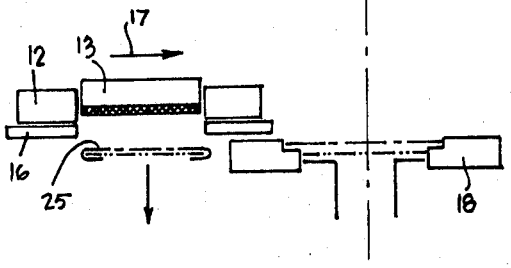
FIG. 9
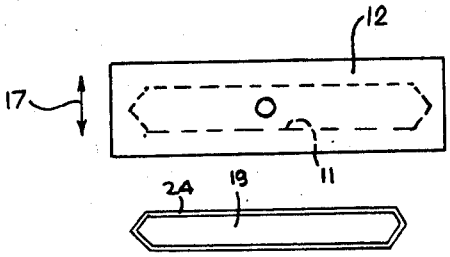
FIG. 10

REVERSED MOVING DIE FOLDING AND CREASING MACHINE

This is a continuation-in-part application of application Ser. No. 137,644 filed Apr. 7, 1980, now abandoned.

BACKGROUND OF INVENTION (a) (i) Field of the Invention

The present invention relates to an improved edge folding and creasing machine for pliable materials wherein there is provided a stationary support plate having a reciprocal flat punch head therein, and a moving die having a die cavity to receive the punch head which supports the material intended to be folded and creased along its circumferential edge.

(a) (ii) Advantages of the Invention

The machine of the present invention saves lining material used in the creasing process in the needle trade industry and improves the material edge folding and creasing techniques.

(b) Description of Prior Art

Various types of creasing machines and methods are known. However, the majority of these have disadvantages and limitations such as:

i. To use the prior art machines, the fused lining and fabric must have the same configuration of the cut material.

ii. The fused lining must be fusable on both faces.

iii. The finished product produced with the prior art machines has a thick edge specially at the sharp corners which results in irregularities along its circumferential edge.

iv. During the pressing operation of the prior art machines, the machines stand idle and the operator has to stand around and wait until the end of the pressing cycle to release the finished product. This, of course, wastes the valuable time of the operator. Because of this, machine manufacturers are forced to design machines with as little pressing time as possible.

v. Since the pressing time must be made as short as possible, special lining material is needed, which lining material will respond in the shortest possible pressing time.

vi. The prior art machines also have functional limitations in that the folding machine without a lining "crimper" cannot function as a creasing machine and vice versa.

vii. The prior art machines cannot provide a fuseable liner only along the folded edge of the material.

viii. Furthermore, prior art process of folding and creasing is substantially slow, resulting in an expensive operation which is labour intensive. Still further, with the machines heretofore known, the positioning of the lining material onto the facing material is not very precise and when a lining material is concentrically offset, the folded edge of the facing fabric will be thicker in some parts of its circumference whilst in other parts there may not be any lining at all.

SUMMARY OF INVENTION

It is a feature of the present invention to provide an edge folding and creasing machine and method which substantially overcomes the above-mentioned disadvantages.

A further feature of the present invention is to provide an edge folding and creasing machine and method which is substantially entirely automatic and which results in precise positioning of a lining fabric on a facing fabric.

A further feature of the present invention is to provide an improved edge folding and creasing machine which decreases the time of operation, provides a finished product with folded edges of superior quality, and provides a finer folded edge.

Another feature of the present invention is to provide an edge folding and creasing machine having a stationary support plate and a moving die having a die cavity, and wherein at least two dies may be provided for each support plate whereby when the material is being folded and creased in one die cavity, the finished product is being released from the other die cavity.

Another feature of the present invention is to provide an edge folding and creasing machine which can position and secure a lining fabric only between the folded edge of the material.

According to the above features, from a broad aspect, the present invention provides an edge folding and creasing machine comprising a die having a die cavity with a wall surface therein in juxtaposition to an open end of the cavity. Folding plates are provided adjacent the open end of the cavity. A support plate is also provided and having a punch cavity with a flat punch head therein. Means is provided for displacing the die with respect to the support plate for aligning the cavities. Means is further provided to displace the punch head out of the cavity from an open end thereof and into the die cavity with a fabric material disposed on a front face of the punch head and protruding about an outer periphery thereof. Actuating means effects planar displacement of the folding plates inwardly of the die cavity open end to fold the protruding material over a peripheral back face of the punch head to form a folded edge about the fabric. Retracting means is provided to retract the punch head from the die cavity free of the material. Means is further provided to release the material from the die cavity.

DESCRIPTION OF DRAWINGS

A preferred embodiment of the present invention will now be described with reference to the accompanying drawings in which:

FIGS. 1 to 9 are schematic side views showing the basic elements of the edge folding and creasing machine of the invention and the various sequences of operation of its elements to fold and crease a peripheral edge of a fabric;

FIG. 10 is a top view showing a configuration of the punch and die cavity;

FIG. 14 is a fragmented section view illustrating the relationship of the shield plate with respect to the punch head and folded fabric. This Figure is out of sequence and appears on the sheet with FIGS. 1 to 5.

DESCRIPTION OF PREFERRED EMBODIMENTS

Figure 13:
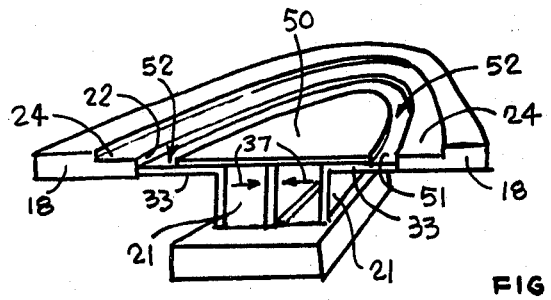
FIG. 13 is a fragmented perspective view showing an improvement wherein a shield plate is movable with the punch head to provide for positioning of strip liners and holding of the fabric in the die cavity during retraction of the punch head.

Referring now to the drawings, and more particularly to FIGS. 1 to 10, there is shown the basic constituent parts which constitutes the edge folding and creasing machine of the present invention. The machine comprises a die 10 having a die cavity 11 therein defined between a die body 12 and a bottom wall 13 herein having a pressure pad 15 located juxtaposed to an open end 14 of the cavity 11. The bottom wall 13 is movable towards the open end 14 for the application of pressure, as shown in FIG. 5. The outer surface of the wall 13 is provided with a rubber facing fabric to constitute the pressure pad 15.

Folding plates 16 are movably secured to the die body 12 and positioned circumferentially about the open end 14 and displaceable inwardly of the cavity 11.

The die 10 is also mounted for displacement in the direction of arrow 17 whereby it may be positioned adjacent a stationary support plate 18 having a punch cavity 19 in a top wall 20 thereof.

A flat punch head 21 is supported in the bottom end 22 of the punch cavity 19 and is displaceable outwardly of the punch cavity 19 in the direction of arrows 23 (see FIGS. 2 and 3).

The supporting plate 18 is provided with a circumferential support edge 24 in a top end of the support plate 18 to receive and support a facing fabric 25 precut to a predetermined pattern coinciding with the shape or circumference of the support edge. The support edge 24 extends throughout the circumference of the punch cavity 19. As herein shown, a lining fabric 26 is also positionable in the punch cavity 19 and rests in the bottom end of the cavity which is contoured to be concentric with the facing fabric 25. The lining fabric 26 is positioned onto the front face 27 (see FIG. 6) of the punch head 21.

As shown in FIG. 1, the lining fabric 26 and facing fabric 25 are inserted into the punch cavity 19 and the die 10 is then moved into position over the support plate 18 with the cavities 11 and 19 juxtaposed concentrically. The cavity 11 is substantially of the same size as the bottom end 22 of the cavity 19. This juxtaposed position is shown in FIG. 2.

With the die 10 and the support plate 18 juxtaposed, the punch head 21 is then moved outwardly of the support plate 18 in the direction of arrow 23 and into the cavity 11 with the facing fabric resting against the rubber facing pressure pad 15 of the bottom wall 13. As the punch head moves into the die cavity, the facing fabric material at its terminal edges 28, and which extends beyond the peripheral edge of the lining fabric 26, will be pushed inwardly towards the punch head 21 due to its frictional engagement with the leading edge 29 of the folding plate 16 and the side wall 30 of the cavity 11. Thus, a marginal edge of the facing fabric is automatically folded at a 90° angle as the punch head enters the die cavity.

After the punch head is located in the die cavity, the folding plates 16 are then actuated to move inwardly about the circumferential edge of the cavity 11 whereby to fold the protruding marginal edge material 28 inwardly and onto a peripheral back face 31 of the punch head 21. Thus, the marginal edge material 28 is now lying substantially parallel to the portion of the facing fabric against the pressure pad and a peripheral portion of the punch head is located between the edge layers of the folded fabric. This position is illustrated in FIG. 4.

Figure 12:
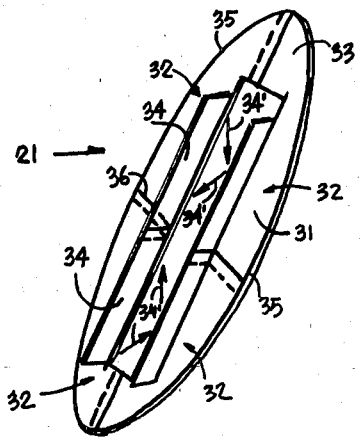
FIG. 12 is a perspective view of an example of the construction of the flat punch head.

Referring now to FIGS. 5 and 6, there is shown the retraction sequence of the flat punch head. Before describing this sequence, reference is made to FIG. 12 which shows a typical example of the construction of the flat punch head 21. As herein shown, the punch head is comprised of quadrant sections 32 each comprised of a flat support plate 33 and an actuating arm 34. The actuating arm 34 is connected to a punch head retracting mechanism (not shown) whereby to cause each quadrant section or flat support plate 33 to retract in an oblique direction as shown by arrows 34' whereby the terminal edge 35 of each plate 33 is retracted from the folded edge of the material 25. The lower ends 36 of each plate 33 are juxtaposed as well as the actuating arms 34 whereby this oblique retraction of the section may be effected.

As shown in FIG. 4, the first step of the withdrawing of the punch head is to cause inward planar displacement of the plates 33 in the direction of arrows 37. Thus, the terminal edges 35 of the plates 33 are freed from the peripheral folded edge, as shown in FIG. 5. In order to retain the fabric of the folded edge in position in the cavity 11 during this retraction sequence, the top front face of the pressure pad 15 is made of a silicon rubber material.

As shown in FIG. 5, the punch head 21 is then retracted downwardly in the direction of arrow 38 and then each section of the punch moves back towards its original position by outward oblique displacement in the direction of arrows 39 (arrows 34' in FIG. 12) until it assumes its loading position as shown in FIG. 7.

With the punch head retracted from the marginal folded edges of the fabric, the pressure pad then presses downwardly in the direction of arrow 40 to form a permanent peripheral crease in the folded material. At the same time, the folding plates 16 will apply heat to the folded material to form a permanent crease and also to fuse the lining material 26. The marginal edge of the facing fabric is thus permanently creased and the lining fabric is in substantially perfect position thereunder.

The die 10 is now displaced to its fabric release position as shown in FIG. 7. Of course, the crease and the application of heat does not necessarily have to be performed at the location shown in FIGS. 5 and 6 as this can be done at the location shown in FIG. 7. This is particularly advantageous when using a multi-die arrangement as will be later described with reference to FIG. 1. As shown in FIGS. 7 to 9, the punch cavity 19 in the punch plate 18 is now open whereby it can be loaded with the lining and facing fabrics. The pressure is then released from the pressure pad 15 and the folding plates 16 are retracted. The facing fabric with the folded marginal edge then falls out of the die cavity by gravity and onto a stack or a conveyor, positioned under the die 10.

Referring now to FIGS. 13 and 14 there is shown an improvement of the edge folding and creasing machine and wherein a shield plate 50 is supported on the front face 51 of the punch head 21. The shield plate 50 has a smaller identical configured contour as the outer contour of the punch plate 33 constituting the punch head 21 and is supported concentrically therewith to define a liner locating channel 52 about the outer edge thereof and the peripheral wall of the bottom end 22 of the punch cavity 19. A strip of fuseable lining material 26' is disposed along the locating channel 52 over the front face 51 of the punch plates 33. The shield plate 50 is movable In and out of the punch cavity 19 and into the cavity 11 with the fabric 25 positioned over the strip liner 26', whereby the fabric 25 is held in pressure against the outer face 53 of the bottom wall 13.

As shown in FIG. 14 the folding and creasing machine is at its folding stage as shown in FIG. 4 with the folding plate 16 having moved inwardly to fold the terminal edges 28 of the fabric 25 under the peripheral back face 31 of the punch 21. The flat punch plates 33 can now be withdrawn inwardly in the direction of arrows 37, as also shown in FIG. 4, and it can be seen that the fabric 25 will be substantially undisturbed during this withdrawal sequence of the punch plates 33. The strip liner 26' is held firmly in position and cannot be displaced along its planar axis as it is in abutment with the peripheral end edge 54 of the support shield plate 50 and it has already been fused to the fabric 25.

After the punch plates 33 have retracted it is then lowered back into the cavity 19 as shown in FIG. 5. The shield plate 50 will be retracted with the punch head 21.

Figure 11:
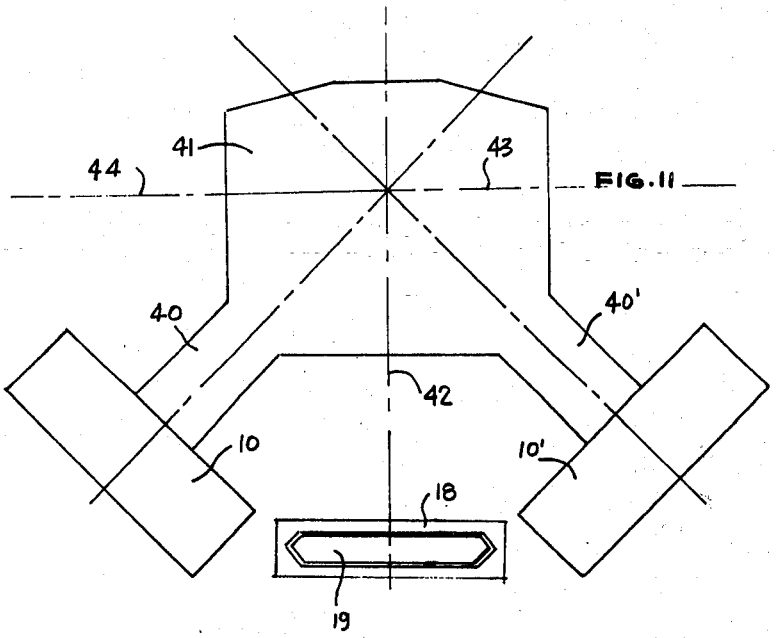
FIG. 11 is a top schematic view showing a modification of the machine wherein two dies are provided for reciprocal movement with respect to a single punch cavity.

As shown in FIG. 11, the machine may be provided with two or more dies 10, 10', etc., each having a die cavity. These dies would be mounted on displaceable arms 40, 40', etc., secured to a rotating or reciprocating frame 41 with the axes of the arms 40 and 40' being disposed at 90° to one another. Thus, when the die 10 is located on axis 42 over the support plate 18 and with the cavities 11 and 19 juxtaposed, the folded edge is being formed. Whilst this is taking place, the already folded material in the die 10' which is now resting at its unloading position with the arm 40' lying along axis 43, heat may be applied to the folded edge to effect a permanent creasing and the fusing of the lining material, and the finished product is then released from the die. The next sequence of movement in the drive frame may be to that position as indicated on FIG. 11 in solid line giving an operator sufficient time to load the punch cavity 19 before the arm 40' is aligned on the axis 42. Of course, the loading can also be done automatically by machine to cut this delay time. With the die cavity 11' juxtaposed to the cavity 19, the other die 10 is in its unloading position on axis 44. Of course, instead of a reciprocating arrangement, the drive frame 41 may be provided with more arms 40 and the machine can operate as a turret with more punch cavities 19 being located circumferentially about the turret.

It is within the ambit of the present invention to provide any obvious modifications of the examples thereof described hereinabove, provided such modifications fall within the scope of the appended claims.

I claim:

1. An edge folding and creasing machine comprising a die having a die cavity therein, a wall surface in said cavity juxtaposed to an open end of said cavity, folding plates adjacent said open end, a support plate having a punch cavity, a flat punch head in said punch cavity, means for displacing said die with respect to said support plate for aligning said cavities, means to displace said punch head out of said cavity from an open end thereof and into said die cavity with a fabric material disposed on a front face of said punch head and protruding about an outer periphery thereof, actuating means to effect planar displacement of said folding plates inwardly of said die cavity open end to fold said protruding marginal edge material over a peripheral back face of said punch head to form a folded peripheral edge about said fabric, retracting means to retract said punch head from said die cavity free of said material, means to release said material from said die cavity, and a shield plate supported on said front face of said punch head, said shield plate having a smaller identical configured contour as said punch head and disposed concentrically therewith to define a liner locating channel about its outer edge to locate a strip of lining material about a peripheral edge portion of said punch head front face.

2. A machine as claimed in claim 1 wherein said punch head comprises two or more flat plates supported in planar alignment to delineate a contour pattern, said punch cavity being configured and concentric to said contour pattern of said flat plates, said retracting means including actuating means to withdraw said flat plates inwardly toward each other in planar alignment and outwardly of said die cavity back into said punch cavity.

3. A machine as claimed in claim 2 wherein said punch cavity is further provided with a material circumferential support edge extending beyond and concentric with said punch cavity.

4. A machine as claimed in claim 3 wherein said wall surface of said die cavity is movable, a pressure pad secured to said wall surface, said wall surface being displaceable toward said front face of said punch head to apply pressure to said material positioned over said flat plates of said punch head to form a creased folded edge about said material in said die cavity.

5. A machine as claimed in claim 4 wherein said facing material is pre-cut for close fit in said support edge of said punch cavity, a pre-cut lining fabric supported on said punch front face and extending juxtaposed thereto and under said facing fabric.

6. A machine as claimed in claim 5 wherein said folding plates are heated to crease said folded edge of said mterial, said lining material being a fuseable lining material.

7. A machine as claimed in claim 4 wherein said pressure pad has a rubber face in contact with said facing fabric for friction retention thereof.

8. A machine as claimed in claim 2 wherein said die is displaceable from a material release position free of said support plate to release said material with a creased folded edge, and to a punch receiving position where said cavities are juxtaposed.

9. A machine as claimed in claim 8 wherein said folding plates are supported in fixed relationship to said die cavity, said folding plates being retractable to constitute said means to release said material from said die cavity.

10. A machine as claimed in claim 2 wherein there is provided two or more of said dies each having one cavity, said dies being secured in a respective die support frame each fixedly secured with respect to each other to a reciprocating mechanism whereby when one of said dies has its cavity juxtaposed with said punch cavity the other of said dies is in a material release position.

11. A machine as claimed in claim 2 wherein said punch head comprises four flat plates, two of said plates forming half the surface area of said punch head and retractable inwardly toward ech other, said two plates of each half of said surface area of said punch head also being retractable toward each other in overlapping relationship whereby an outer peripheral edge of said four plates are withdrawn from a peripheral folded edge of said fabric prior to withdrawing said punch head from said die cavity.

12. A machine as claimed in claim 1 wherein said shield plate is a thin flat plate displaceable with said punch head out of said cavity and into said die cavity with said fabric material disposed thereover to maintain said fabric material in pressure against said wall surface of said cavity to hold the material during the retraction of said punch head.

13. A machine as claimed in claim 12 wherein said two or more flat plates are disposed parallel to and immediately below said thin flat plate and retractable to at least said outer edge of said thin flat plate, said folded peripheral edge about said fabric extending about said liner locating channel.

14. A machine as claimed in claim 1 wherein said folding plates are heated to crease said folded edge of said material, said lining material being a fuseable lining material.

* * * * *